US008622048B2

(12) United States Patent
Young et al.

(10) Patent No.: US 8,622,048 B2
(45) Date of Patent: Jan. 7, 2014

(54) THREE-PORT VALVE

(75) Inventors: Kevin L. Young, Mansfield, OH (US); James Rockwell, Bellville, OH (US)

(73) Assignee: Stoneridge, Inc., Warren, OH (US)

( * ) Notice: Subject to any disclaimer, the term of this patent is extended or adjusted under 35 U.S.C. 154(b) by 226 days.

(21) Appl. No.: 13/080,159

(22) Filed: Apr. 5, 2011

(65) Prior Publication Data

US 2011/0240896 A1 Oct. 6, 2011

Related U.S. Application Data

(60) Provisional application No. 61/321,075, filed on Apr. 5, 2010.

(51) Int. Cl.
*F02M 37/20* (2006.01)
*F02M 37/00* (2006.01)

(52) U.S. Cl.
USPC ..... 123/516; 123/518

(58) Field of Classification Search
USPC ..... 123/516, 518, 519, 520, 521, 568.21; 251/129.09, 129.1
See application file for complete search history.

(56) References Cited

U.S. PATENT DOCUMENTS 2,322,911 A 6/1943 Bean
2,704,649 A 3/1955 Ellenberger
4,859,005 A * 8/1989 Rey et al. ..... 303/119.3
5,269,278 A 12/1993 Heinemann
5,309,944 A * 5/1994 Chikamatsu et al. .... 137/625.65
5,570,721 A * 11/1996 Funke et al. ..... 137/625.65
5,860,407 A 1/1999 Chapin et al.
6,227,183 B1 * 5/2001 Miyoshi et al. ..... 123/568.23
6,279,552 B1 * 8/2001 Okada et al. ..... 123/568.2
6,708,675 B2 * 3/2004 Kato et al. ..... 123/568.12
6,814,339 B2 11/2004 Berger et al.
2002/0104516 A1 * 8/2002 Kaiser et al. ..... 123/520
2009/0133672 A1 * 5/2009 Crisan ..... 123/518
2009/0140186 A1 * 6/2009 Kunz et al. ..... 251/129.2
2009/0288645 A1 11/2009 Childress et al.

OTHER PUBLICATIONS

International Search Report and Written Opinion dated Jun. 14, 2011 issued in related International Patent Application No. PCT/US2011/031194.

* cited by examiner

*Primary Examiner* — Mahmoud Gimie
(74) *Attorney, Agent, or Firm* — Grossman, Tucker, Perreault & Pfleger, PLLC

(57) ABSTRACT

A three-port valve includes a valve body including a first port, a second port, and a third port, the first port having a first valve orifice and the second port having a second valve orifice. The valve may also include a first valve closure member and a second valve closure member, the first and second valve closure members may be configured to selectively seal the first and second valve orifices, respectively. The valve may further include a solenoid including a first coil and a second coil, at least one of the first and second coils configured to actuate at least one of the first and second valve closure members when energized. Additionally, the valve may include an electrical connection configured to selectively and individually energize the first and second coils. The valve may be configured to operate in at least three different states of operation. For example, the three-port valve may have a first state (e.g., a default state) when neither coil is energized, a second state when first coil is energized to move only one of the valve closure members, and a third state when the second coil is energized to move both valve closure members.

11 Claims, 5 Drawing Sheets

THREE-PORT VALVE

CROSS REFERENCE TO RELATED APPLICATIONS

The present application claims the benefit of U.S. Provisional Patent Application Ser. No. 61/321,075, filed Apr. 5, 2010, the entire disclosure of which is incorporated herein by reference.

FIELD

The present disclosure relates generally to valves, and, more particularly, to three-port valves for evaporative emissions control systems.

BACKGROUND

Solenoids are used in a myriad of applications in the automotive industry. For example, solenoids may be used in automated or remote valves, such as a canister vent solenoid associated with evaporative emission control systems. Such solenoid valves may be used to control the flow of a variety of fluids (e.g., liquids or gasses). For example, in the context of a canister vent solenoid, the solenoid valve may be used to control the flow of fuel vapors into a charcoal canister. Solenoid valves may be similarly used to control the flow of liquids and vapors for other vehicle systems.

In some applications, it may be desirable to provide control over two input sources. This may be accomplished by providing two separate valves. The use of two separate valves, however, may increase costs and may be difficult to package, particularly in applications where space is at a premium. Additionally, operating two separate valves may further complicate the programming, particularly since it may be necessary or desirable to control the two separate valves independently and/or simultaneously.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

By way of an overview, one aspect consistent with the present disclosure may feature a three-port valve comprising a solenoid including two coils coupled to a valve body including two input ports, one output port, and two valve closure members. Three different states of operation of the three-port valve may be selected based on selectively energizing each of the two coils. For example, the three-port valve may have a first state (e.g., a default state) when neither coil is energized, a second state when first coil is energized to move only one of the valve closure members, and a third state when the second coil is energized to move both valve closure members. The three-port valve may therefore provide a more compact assembly compared to having two separate valves. In addition, the three-port valve may use only a single electrical connection whereas two separate valves may need two separate connectors and associated wiring. Moreover, the three-port valve may require fewer hose connections compared to two separate valves because it may eliminate the need for hosing between the valves. Accordingly, the installation and manufacture of the three-port valve may be reduced/less complex.

Figure 1:
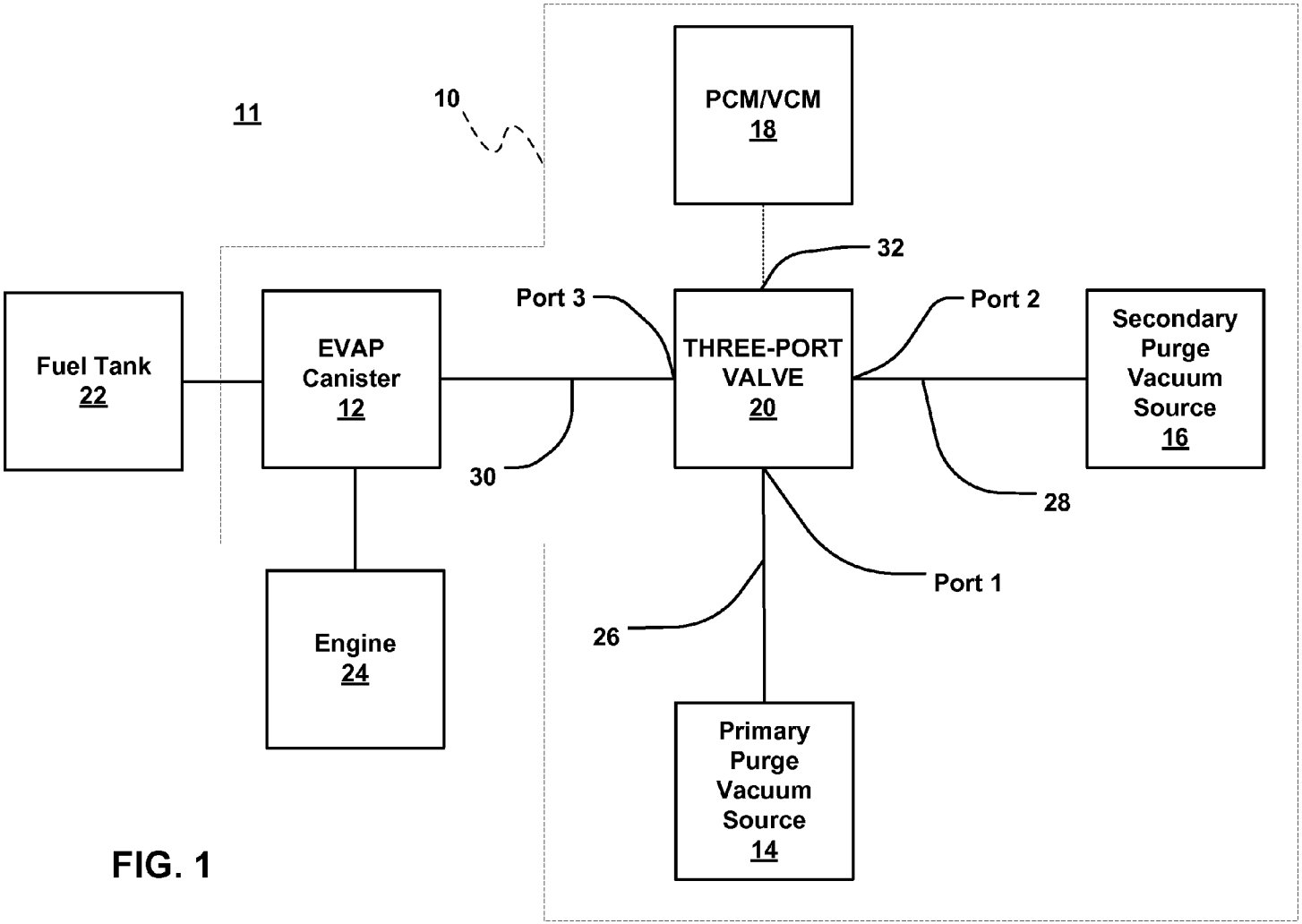
FIG. 1 is a block diagram illustrating a system including a three-port valve consistent with one embodiment of the present disclosure.

Referring to FIG. 1, one embodiment of an evaporative emissions system 10 is schematically illustrated. As shown, the evaporative emissions system 10 may comprise an EVAP canister 12, a primary purge vacuum source 14, a secondary purge vacuum source 16, an engine management controller (PCM/VCM) 18, and a three-port valve 20. The EVAP system 10 may control the release of fuel vapors from a fuel tank 22 during refueling, during elevated temperatures, etc., in which fuel vapors from the fuel tank 22 of a vehicle 11 may be displaced from, e.g. due to being pressurized within, the fuel tank 22 by liquid fuel being delivered to the fuel tank 22. Fuel vapors from the fuel tank 22 may travel to the evaporative emissions canister 12, which may serve as a storage device for fuel vapors. The evaporative emissions canister 12 may contain a medium, such as activated carbon, which may collect the fuel vapors to prevent the vapor from being emitted into the atmosphere. During operation of the internal combustion engine 24 of the vehicle 11, the fuel vapors collected by the evaporative emissions canister 12 may be released to the engine 24 and may be consumed by the engine 24.

According to one embodiment, the three-port valve 20 may be used during an OBDII emissions vacuum test. In particular, some vehicles 11 (such as, but not limited to, hybrid vehicles including hybrid plug-in vehicles) may perform an OBDII emission vacuum test for leakage even when the internal combustion engine 24 is not operating. The three-port valve 20 may include a first port (i.e., Port 1) fluidly coupled to the primary purge vacuum source 14 (e.g., via primary purge path 26), a second port (i.e., Port 2) fluidly coupled to the secondary purge vacuum source 16 (e.g., via secondary purge path 28) and a third port (i.e., Port 3) fluidly coupled to the EVAP canister 12 (e.g., via EVAP path 30). The three-port valve 20 may also include an electrical connection 32 configured to be electrically coupled to the PCM/VCM 18. Based on the signal received from the PCM/VCM 18 (e.g., but not limited to, 12 volt signals), the three-port valve 20 may selectively open/close the Ports 1-2 to Port 3 in one of three valve states.

Figure 2:
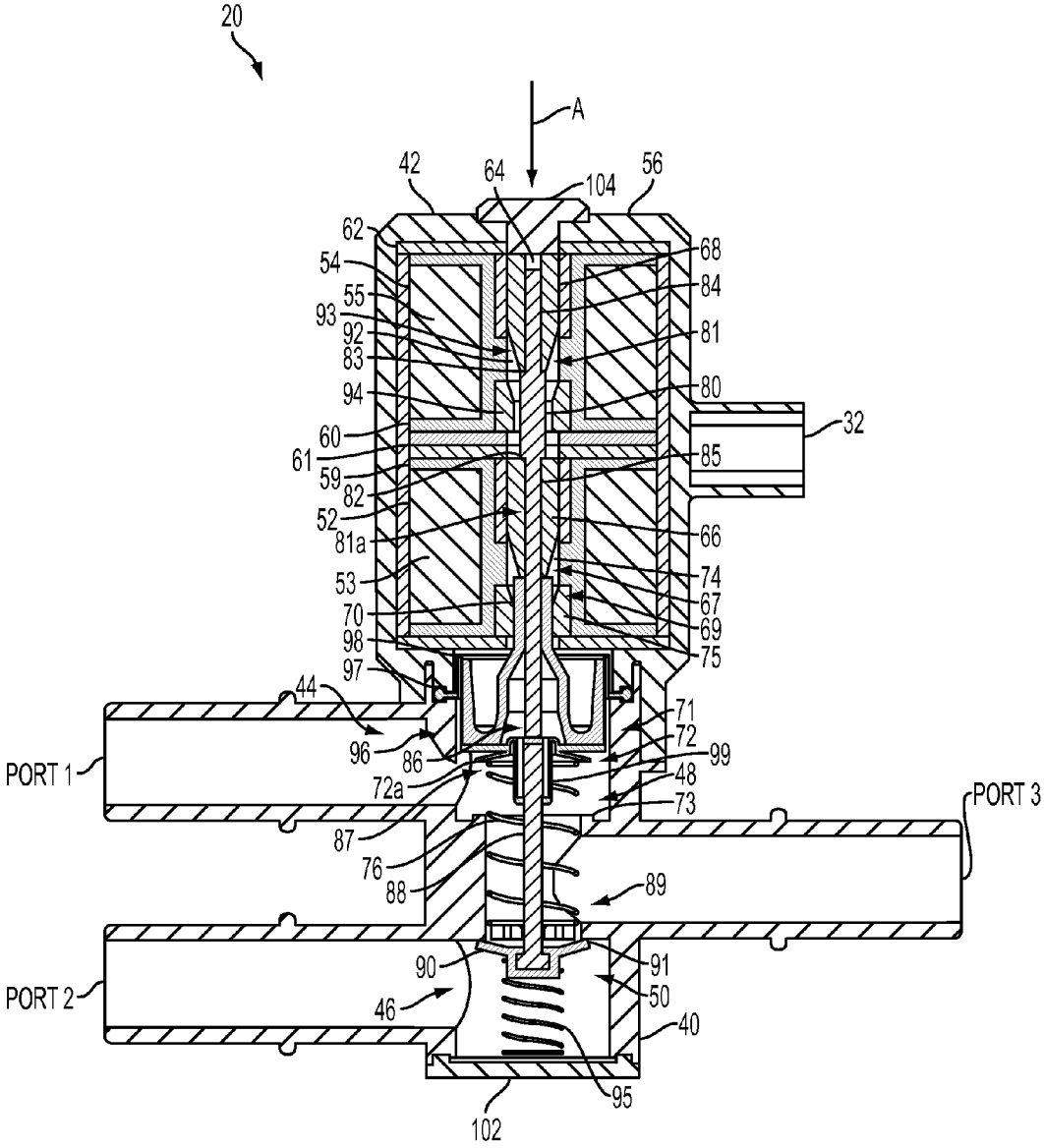
FIG. 2 is a cross-sectional view of one embodiment of the three-port valve consistent with the present disclosure in a first state.
Figure 3:
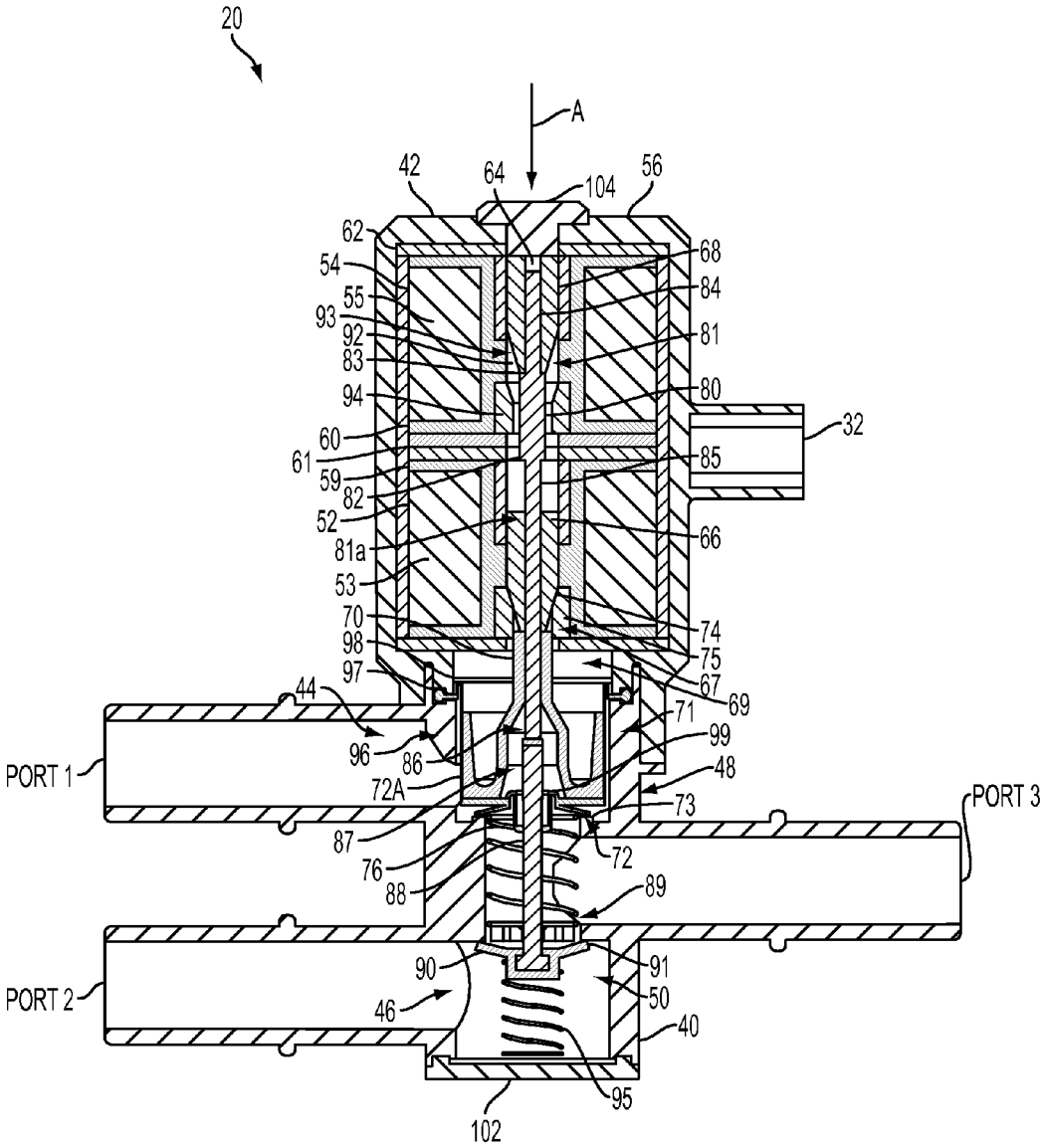
FIG. 3 is a cross-sectional view of the three-port valve shown in FIG. 2 consistent with the present disclosure in a second state.
Figure 4:
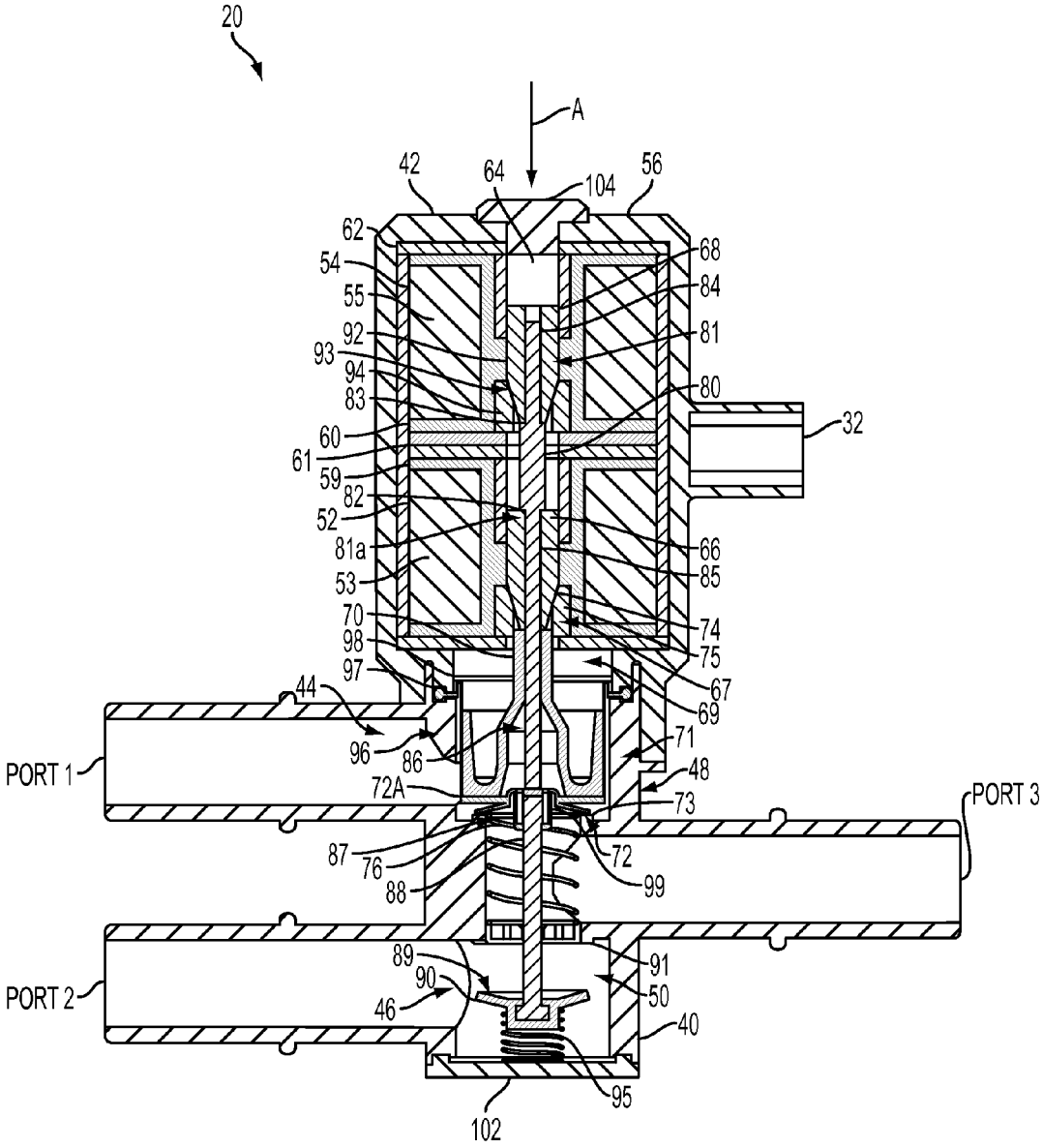
FIG. 4 is a cross-sectional view of the three-port valve shown in FIG. 2 consistent with the present disclosure in a third state.

Turning now to FIGS. 2-4, cross-sectional views of the three-port valve 20 are shown illustrating the three-port valve 20 in three states of operation. The three-port valve 20 may comprise a valve body 40 and a solenoid 42. The valve body 40 may comprise Ports 1-3 as well as a first and a second valve closure member 44, 46 configured to selectively open and seal valve orifices 48, 50, respectively. The solenoid 42 may comprise a first and a second coil 52, 54 configured to actuate the first and/or the second valve closure members 44, 46 such that the three states of the three-port valve 20 may be selected. For example, FIG. 2 may represent the three-port valve 20 in a first state (e.g., a default state) in which neither the first nor the second coil 52, 54 is energized. As may be seen, the first valve closure member 44 may be open to establish a fluid pathway from Port 1 through the first valve orifice 48 to Port 3. The second valve closure member 46 may be sealed to the second valve orifice 50 to seal Port 2 from Port 3.

FIG. 3 may represent a second state of the three-port valve 20 in which the first coil 52 has been energized to actuate the first valve closure member 44. As a result, the first valve closure member 44 may be sealed to the first valve orifice 48 to seal Port 1 from Port 3. The second valve closure member 46 may remain sealed to the second valve orifice 50 to seal Port 2 from Port 3. FIG. 4 may represent a third state of the three-port valve 20 in which the second coil 54 has been energized to actuate both the first and the second valve closure members 44, 46. As a result, the first valve closure member 44 may be sealed to the first valve orifice 48 to seal Port 1 from Port 3. The second valve closure member 46 may be open to establish a fluid pathway from Port 2 through the second valve orifice 50 to Port 3.

Referring now to FIG. 2, the solenoid 42 may comprise a solenoid housing 56 configured to receive the first and the second coils 52, 54. The coils 52, 54 may be made by winding a first and a second coil wire 53, 55 around a first and a second bobbin 59, 60, respectively. The coils 52, 54 may be received by a first and a second yoke 61, 62, respectively, which in turn may be received within the solenoid housing 56. The yokes 61, 62 may be made from a magnetic material, and may form part of a magnetic field when a respective one of the coils 52, 54 is energized. The coils 52, 54 may be selectively energized, for example, to generate first and second magnetic fields upon receiving signals (e.g., but not limited to, 12 volt signals) at the electrical connector 32.

The first and second coils 52, 54 may define a central passageway 64. A first and a second armature 66, 68 may be slidingly disposed within the central passageway 64. A distal end region 67 of the first armature 66 may be configured to engage (e.g., abut) against a proximal end region 69 of a plunger 70. A distal end region 71 of plunger 70 may be coupled to the first valve closure member 44. The first valve closure member 44 may include a first sealing surface 72 configured to seal with a first valve seat 73 of the first valve orifice 48. According to one embodiment, the first sealing surface 72 may comprise a flange 72*a* or the like.

In practice, the first coil 52 may be energized to produce a magnetic field. The resulting magnetic field may attract and/or repel the first armature 66 generally along arrow A within the central passageway 64 from the first state illustrated in FIG. 2 (e.g., the default state) to the second state illustrated in FIG. 3. The first armature 66 may move into a first void space 74 within the central passageway 64 as the first armature 66 moves in direction of arrow A. According to one embodiment, the distal end region 67 of the first armature 66 may include a tapered profile configured to engage a corresponding tapered profile of a first bushing 75 when in the second state (FIG. 3) to limit the movement of the first armature 66.

As the first armature 66 moves from the first state (FIG. 2) to the second state (FIG. 3), the distal end region 67 of the first armature 66 may engage (e.g., abut) the proximal end region 69 of the plunger 70, urging the plunger 70 generally along arrow A within the central passageway 64. As the plunger 70 is urged in the direction of arrow A, the first valve closure member 44 (e.g., the sealing surface 72 or flange 72*a*) may be seated against the first valve seat 73 of the first valve orifice 48, thereby sealing Port 1 from Port 3. A first return spring 76 may be provided to urge the plunger 70 and sealing surface 72/flange 72*a* in the direction opposite to arrow A. The force generated by the magnetic field of the first coil 52 acting on the first armature 66 to move the plunger 70/sealing surface 72/flange 72*a* in the direction of arrow A may be greater than the force generated by the first return spring 76 urging the plunger 70/sealing surface 72/flange 72*a* in the opposite direction. The force generated by the first return spring 76 may be sufficient to unseat the sealing surface 72/flange 72*a* from the first valve seat 73 when the first coil 52 is not energized.

A first valve rod 80 may be slidingly disposed within the central passageway 64 and may extend at least partially though/within the first and second armatures 66, 68. For example, a proximal end region 81 of the first valve rod 80 may be at least partially disposed within the cavity 84 of the second armature 68 and second portion 81*a* of the first valve rod 80 may extend through the cavity 85 of the first armature 66. The first valve rod 80 may also include a first and a second shoulder 82, 83. The first and second shoulders 82, 83 may have an outer diameter greater than the internal diameter of the cavities 84, 85, respectively, through which the first valve rod 80 is disposed. A distal end region 86 of the first valve rod 80 may be configured to engage a proximal end region 87 of a second valve rod 88. A distal end region 89 of the second valve rod 88 may be coupled to the second valve closure member 46. According to one embodiment, the second valve closure member 46 may comprise a poppet valve 90 or the like configured to seal with a second valve seat 91 of the second valve orifice 50.

In practice, the second coil 54 may be energized to produce a magnetic field. The resulting magnetic field may attract and/or repel the second armature 68 generally along arrow A within the central passageway 64 from the first state illustrated in FIG. 2 (e.g., the default state) to the third state illustrated in FIG. 4. The second armature 68 may move into a second void space 92 within the central passageway 64 as the second armature 68 moves in direction of arrow A. According to one embodiment, the distal end region 67 of the first armature 66 may include a tapered profile configured to engage a corresponding tapered profile of a second bushing 94 when in the third state (FIG. 4) to limit the movement of the second armature 68.

As the second armature 68 moves from the first state (FIG. 2) to the third state (FIG. 4), the distal end region 93 of the second armature 68 may engage (e.g., abut) the first shoulder 81 of the first valve rod 80, urging the first valve rod 80 generally along arrow A within the central passageway 64. The distal end region 86 of the first valve rod 80 may then urge the proximal end region 87 of the second valve rod 88, which in turn may urge the distal end region 89 of the second valve rod 88 and the second valve closure member 46 (e.g., the poppet valve 90) out of engagement (e.g., unseat) with the second valve seat 91 of the second valve orifice 50.

In addition, the second shoulder 82 engages (e.g., abuts) the first armature 66 as the first valve rod 80 is urged in the direction of arrow A, causing the first armature 66 to move the plunger 70 in the direction of arrow A as generally described herein. Accordingly, activating the second coil 54 may move the second armature 68 in the direction of arrow A, causing both the first and second valve rods 80, 88 as well as the plunger 70 to move in the direction of arrow A, thereby moving the first and the second valve closure members 44, 46 from the first state illustrated in FIG. 2 to the third state illustrated in FIG. 4 in which the first valve closure member 44 seals the first valve orifice 48 and the second valve closure member 46 is unsealed from the second valve orifice 50.

A second return spring 95 may be provided to urge the poppet valve 90 in the direction opposite to arrow A. The force generated by the magnetic field of the second coil 52 acting on the second armature 68 to be sufficient to move the plunger 70 and the poppet valve 90 in the direction of arrow A may be greater than the force generated by the first and the second return springs 76, 95 urging the plunger 70 and the poppet 90 in the opposite direction. The force generated by the second return spring 95 may be sufficient to seat the poppet valve 95 against the second valve seat 91 when the second coil 54 is not energized.

Accordingly, by selectively energizing the first or the second coils 52, 54, the three-port valve 20 may be arranged in one of three states (e.g., the first or default state illustrated in FIG. 2, the second state illustrated in FIG. 3, and the third state illustrated in FIG. 4). For example, in the first (i.e., default) state, Port 1 is in fluid communication with Port 3 across the first valve orifice 48 while Port 2 is closed (seated or sealed) from Port 3. In the second state, both Ports 1 and 2 are closed (seated or sealed) from Port 3. Activating the first coil 52 may urge the first armature 66 in the direction of arrow A, which in turn may urge the plunger 70 in the direction of arrow A and move the first valve closure member 44 from the open (unseated or unsealed) position illustrated in FIG. 2 to the closed (seated or sealed) position illustrated in FIG. 3. The second valve closure member 46 may remain in the closed (seated or sealed) position against the second valve orifice 50. In the third state, Port 1 is closed (seated or sealed) from Port 3 and Port 2 is in fluid communication with Port 3 across the second valve orifice 50.

Activating the second coil 54 may urge the second armature 68 in the direction of arrow A, which in turn may urge the first valve rod 80 as well as the second valve rod 88 and the plunger 70 in the direction of arrow A, thereby moving the first valve closure member 44 from the open (unseated or unsealed) position illustrated in FIG. 2 to the closed (seated or sealed) position illustrated in FIG. 4 as well as moving the second valve closure 46 from the closed (seated or sealed) position (FIG. 2) to the open (unseated or unsealed) position as illustrated in FIG. 4. Return springs 76, 95 may be configured to urge the first and second valve closure members 44, 46 to the first (i.e., default) position as illustrated in FIG. 2.

Optionally, the three-port valve 20 may include a solenoid seal 96 configured to seal the valve body 40 to the solenoid 42 and to prevent fluid from entering the solenoid 42 from the valve body 40. According to one embodiment, the solenoid seal 96 may be sealed between the valve body 40/solenoid 42 via a circumferential ring 97 and may extend between the first and second valve rods 80, 88. The solenoid seal 96 may also include a first rolling diaphragm 98 and a second rolling diaphragm 99. The first rolling diaphragm 98 may be configured to roll/unroll with respect to the valve body 40/solenoid 42 as the plunger 70 moves between the first state (FIG. 2) and the second and third states (FIGS. 3 and 4). In particular, the first rolling diaphragm 98 is illustrated in FIG. 2 in a "rolled" or "contracted" position and is illustrated in FIGS. 3 and 4 in an "unrolled" or "expanded" position. The second rolling diaphragm 99 may be configured to roll/unroll when the plunger 70 moves with respect to the first and second valve rods 80, 88 as the plunger 70 moves between the first state (FIG. 2) and the second state (FIG. 3). For example, the second rolling diaphragm 99 is illustrated in FIG. 2 in an "unrolled" or "expanded" position and is illustrated in FIG. 3 in a "rolled" or "contracted" position. The solenoid seal 96 may be formed a resiliently deformable material such as, but not limited to, rubber, foam, silicon, or the like configured to allow the first and second rolling diaphragms 98, 99 to resiliently roll/bend under repeated cycles of the first and second coils 52, 54.

Figure 5:
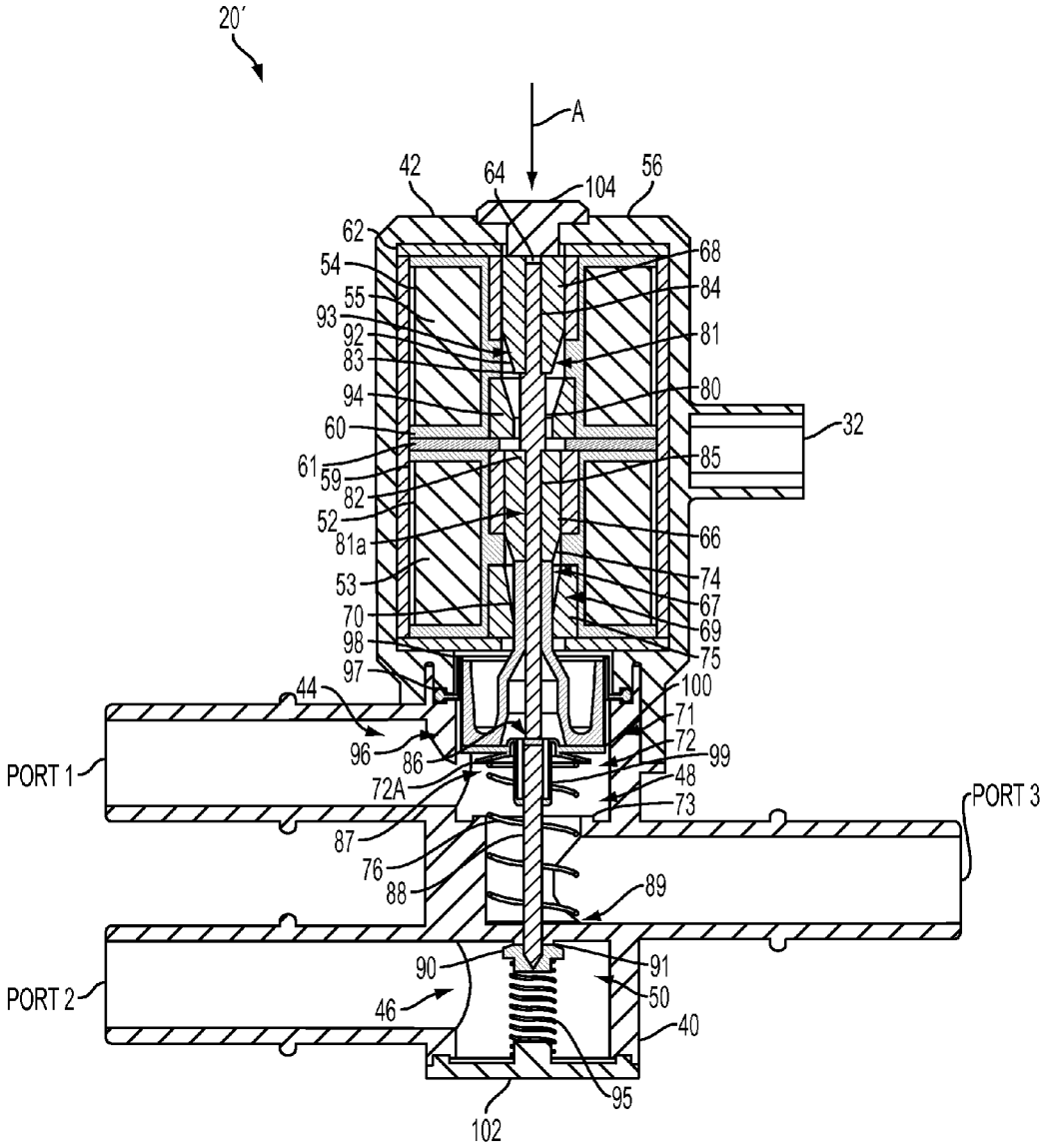
FIG. 5 is a cross-sectional view of another embodiment of the three-port valve consistent with the present disclosure in a first state.

FIG. 5 is a cross-sectional view of another embodiment of the three-port valve consistent with the present disclosure in a first state. While the first valve closure member 48 is illustrated in FIGS. 2-4 having a sealing surface 72 in the form of a flange 72*a* extending generally radially outwardly and away from the distal end region 71 of the plunger 70, the three-port valve 20' of FIG. 5 may include a sealing surface 72 which forms a portion 100 of the solenoid seal 96. For example, the portion 100 of the solenoid seal 96 may seal against the first valve seat 73 and the flange 72*a* may be eliminated.

Additionally, while the first and second valve closure members 44, 46 have been described in a various positions corresponding to the three states or operation, it should be understood that the positions of the first and second valve closure members 44, 46 in the various states of operation may be changed depending on the intended application of the three-port valve 20. For example, both the first and second valve closure members 44, 46 may be opened or closed in the first state (i.e., default state). Additionally, the positions of the first and second valve closure members 44, 46 may be changed when the first and second coils 52, 54 are energized.

The valve body 40 may optionally include a cover 102. The cover 102 may facilitate assembly of the valve body 40, for example, to facilitate loading of the second valve closure member 46. Additionally, the solenoid 42 may optionally include a plug 104. The plug 104 may facilitate assembly of the three-port valve 20 (e.g., the solenoid 42).

Thus, the three-port valve 20 can, within one package, provide three states of operation in a single valve when only one or of the two coils 52, 54 is energized. The unique packaging may allow the three-port valve 20 to be more compact than two separate, 2-port valves and may also allow for a single electrical connector 32 as part of the three-port valve 20 to power two independently operated coils 52, 54. This requires less hosing connections as the three-port valve 20 does not require any connections between the three ports (Ports 1-3). The three-port valve 20 may therefore reduce labor and material costs. The solenoid seal 96 may provide a unique, dual direction rolling diaphragm that allows movement of the plunger 70 and the first/second valve rods 80, 88 together or separately, thereby allowing the independent sealing or concurrent sealing of two separate flow paths through the valve body 40.

The three-port valve 20 may be used for all sizes and combinations of sizes and types of porting and coils necessary for different applications. Lower flow applications may allow for smaller strokes and thus potential for very short diaphragm design. The secondary vacuum seal (e.g., the second valve closure member 46) may be used as system pressure relief if the secondary vacuum source (16, FIG. 1) can address the passage of fuel vapors. As such, one application of the three-port valve 20 may include applications 10 requiring a secondary flow path for a vacuum source (16, FIG. 1) to vacate a system 10 when the primary source of vacuum (14, FIG. 1) through the system 10 is not available.

According to one aspect of the present disclosure there is provided a valve. The valve may include a valve body including a first port, a second port, and a third port, the first port having a first valve orifice and the second port having a second valve orifice. The valve may also include a first valve closure member and a second valve closure member, the first and second valve closure members may be configured to selectively seal the first and second valve orifices, respectively. The valve may further include a solenoid including a first coil and a second coil, at least one of the first and second coils configured to actuate at least one of the first and second valve closure members when energized. Additionally, the valve may include an electrical connection configured to selectively and individually energize the first and second coils. The valve may be configured to operate in at least three different states of operation. When the valve is in a first state, neither the first nor the second coil is energized and the first and second valve closure members are in first positions. When the valve is in a second state, the first coil is energized and the first valve closure member is in a second position. When the valve is in a third state, the second coil is energized and the first valve closure member is in the second position and the second valve closure member is in a second position.

According to another aspect of the present disclosure, there is provided an evaporative emission system. The evaporative emission system may include a fuel tank, an engine, an evaporation canister, a primary purge vacuum source, a secondary purge vacuum source, an engine management controller, and a valve. The valve may include a first port fluidly coupled to the primary purge vacuum source. The valve may also include a second port fluidly coupled to the secondary purge vacuum source. Additionally, the valve may include a third port fluidly coupled to the evaporation canister. The valve may also include an electrical connection configured to be electrically coupled to and communicate with the engine management controller.

In yet another aspect of the present disclosure, there is provided a method of operating a valve. The method may include providing a valve. The valve may include a valve body including a first port, a second port, and a third port, the first port having a first valve orifice and the second port having a second valve orifice. The valve may also include a first valve closure member and a second valve closure member, the first and second valve closure members may be configured to selectively seal the first and second valve orifices, respectively. The valve may further include a solenoid including a first coil and a second coil, at least one of the first and second coils configured to actuate at least one of the first and second valve closure members when energized. Additionally, the valve may include an electrical connection configured to selectively and individually energize the first and second coils. The valve may be configured to operate in at least three different states of operation. The method may further include energizing one of the first and second coils when the valve is in a second and a third state.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed.

The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary. The terms "first," "second," and the like herein do not denote any order, quantity, or importance, but rather are used to distinguish one element from another, and the terms "a" and "an" herein do not denote a limitation of quantity, but rather denote the presence of at least one of the referenced item.

What is claimed is:

1. A valve comprising:

a valve body comprising a first port, a second port, and a third port, said first and second ports having a first and a second valve orifice, respectively;

a first valve closure member and a second valve closure member, said first and second valve closure members configured to selectively seal said first and second valve orifices, respectively;

a solenoid comprising a first coil and a second coil, at least one of said first and second coils configured to actuate at least one of said first and second valve closure members when energized;

an electrical connection configured to selectively and individually energize said first and second coils; and said valve being configured to operate in at least three different states of operation;

wherein, when said valve is in a first state, neither said first nor said second coil is energized and said first and second valve closure members are in first positions;

wherein, when said valve is in a second state, said first coil is energized and a first armature engages a plunger to move said first valve closure member from said first position to a second position;

wherein, when said valve is in a third state, said second coil is energized and a second armature engages a first valve rod to move said first armature to engage said plunger and to move said first and second valve closure members from said first positions to said second positions.

2. The valve of claim 1 wherein, when said valve is in said first state, said first port is configured to fluidly communicate with said third port and said second port is sealed from said third port.

3. The valve of claim 1 wherein, when said valve is in said second state, said first and second ports are sealed from said third port.

4. The valve of claim 1 wherein, when said valve is in said third state, said first port is sealed from said third port and said second port is configured to fluidly communicate with said third port.

5. The valve of claim 1 wherein, when energized, said first and second coils are configured to provide a first and a second magnetic field, respectively, wherein said first magnetic field is configured to move said first armature and said second magnetic field is configured to move said second armature.

6. The valve of claim 1 further comprising a solenoid seal configured to seal and prevent fluid in said valve body from entering said solenoid, said solenoid seal comprising:

a first rolling diaphragm configured to roll and unroll with respect to said valve body and said solenoid when said plunger moves between said first state and said second and third states; and a second rolling diaphragm configured to roll and unroll when said plunger moves with respect to said first and second valve rods as said plunger moves between said first state and said second state.

7. An evaporative emission system comprising:

an evaporation canister; and a valve comprising:

a valve body comprising a first port fluidly configured to be coupled to a primary purge vacuum source, a second port fluidly configured to be coupled to a secondary purge vacuum source, a third port fluidly configured to be coupled to said evaporation canister said first and said second ports having a first and a second valve orifice, respectively;

a first valve closure member and a second valve closure member, said first and second valve closure members configured to selectively seal said first and second valve orifices, respectively;

a solenoid comprising a first coil and a second coil, at least one of said first and second coils configured to actuate at least one of said first and second valve closure members when energized; and an electrical connection configured to be electrically coupled to and communicate with an engine management controller, wherein said electrical connection is further configured to selectively and individually energize said first and second coils;

said valve being configured to operate in at least three different states of operation;

wherein, when said valve is in a first state, neither said first nor said second coil is energized and said first and second valve closure members are in first positions;

wherein, when said valve is in a second state, said first coil is energized and a first armature engages a plunger to move said first valve closure member from said first position to a second position;

wherein, when said valve is in a third state, said second coil is energized and a second armature engages a first valve rod to move said first armature to engage said plunger and to move said first and second valve closure members from said first positions to said second positions.

8. The system of claim 7 wherein, when said valve is in said first state, said first port is configured to fluidly communicate with said third port and said second port is sealed from said third port.

9. The system of claim 7 wherein, when said valve is in said second state, said first and second ports are sealed from said third port.

10. The system of claim 7 wherein, when said valve is in said third state, said first port is sealed from said third port and said second port is configured to fluidly communicate with said third port.

11. The system of claim 7 wherein, when energized, said first and second coils are configured to provide a first and a second magnetic field, respectively, wherein said first magnetic field is configured to move said first armature and said second magnetic field is configured to move said second armature.

* * * * *